United States Patent [19]

Tsai

[11] 4,166,022

[45] Aug. 28, 1979

[54] RECOVERY OF OIL FROM OIL SHALE

[75] Inventor: Shirley C. Tsai, Pittsburgh, Pa.

[73] Assignee: Gulf Research & Development Company, Pittsburgh, Pa.

[21] Appl. No.: 890,074

[22] Filed: Mar. 27, 1978

[51] Int. Cl.[2] ..... C10G 1/00

[52] U.S. Cl. ..... 208/11 R; 208/11 LE

[58] Field of Search ..... 208/11 R, 11 LE

[56] References Cited

U.S. PATENT DOCUMENTS

| | | | |
|---|---|---|---|
| 1,674,420 | 6/1928 | Trumple | 208/11 R X |
| 1,713,794 | 5/1929 | Trumple | 208/11 R X |
| 1,836,051 | 12/1931 | Trumple | 208/11 R X |
| 2,434,815 | 1/1948 | Shaw | 208/11 R X |
| 3,051,644 | 8/1962 | Friedman | 208/11 R |
| 4,028,222 | 6/1977 | Prull | 208/11 R |
| 4,037,658 | 7/1977 | Anderson | 166/272 |

*Primary Examiner*—Delbert E. Gantz
*Assistant Examiner*—William G. Wright

[57] ABSTRACT

A process for recovering oil from oil shale containing kerogen which comprises contacting said oil shale with steam having a partial pressure of at least about 600 psia (4.3 MPa) but no greater than about 3000 psia (20.8 MPa) at a reaction temperature ranging from about 300° C. to about 500° C. for a period of time ranging from about 0.5 to about 6 hours.

13 Claims, No Drawings

RECOVERY OF OIL FROM OIL SHALE

BACKGROUND OF THE INVENTION

1. Field of the Invention

This invention relates to a new and useful process for recovering oil from oil shale containing kerogen, a solid organic, primarily hydrocarbon, material having a high molecular weight, i.e., greater than about 3,000 grams/-mole which comprises about 10 to about 30 percent by weight of oil shale. The percentage recovery, as oil, of the organic matter originally present in the oil shale is low by most methods known in the art. Even the best operations result in relative high conversion of kerogen to carbon and permanent gases, which are of low economic value compared to liquid fuels. Consequently, a need exists for a simple process for recovering oil from oil shale which results in a high yield of liquid product. Accordingly, the present invention provides a higher yield of liquid product by a process for recovering oil from oil shale containing kerogen which comprises contacting said oil shale with steam having a partial pressure of at least about 600 psia (4.3MPa) but no greater than about 3000 psia (20.8 MPa) at a reaction temperature ranging from about 300° C. to about 500° C. for a period of time ranging from about 0.5 to about 6 hours.

2. Description of the Prior Art

U.S. Pat. No. 3,051,644 to L. D. Friedman teaches the recovery of oil from oil shale by subjecting a pumpable water slurry of shale to a jiggling-bed reactor at high temperature (700° to 900° F.) and pressure (1000 to 3000 psig) for long periods of time (20 minutes to 6 hours) (column 1, lines 3–32). An elongated heating zone of restricted cross-sectional area is used as a preheater. In the preheater, water is completely vaporized to form steam and the latter moves at a very high velocity so that a dispersion of shale particles in steam is formed. Thus, a substantial degree of attrition and sintering of the shale particles occurs. Consequently, it is rather difficult to separate the product oil from the spent shale downstream of the reactor.

SUMMARY OF THE INVENTION

I have discovered a novel process for recovering oil from oil shale containing kerogen which comprises contacting said oil shale with steam having a partial pressure of at least about 600 psia but no greater than about 3000 psia at a reaction temperature ranging from about 300° C. to about 500° C. for a period of time ranging from about 0.5 to about 6 hours.

DETAILED DESCRIPTION OF THE PROCESS

Any oil shale containing kerogen can be used in the invention herein. Generally, the shale is pulverized to a size not greater than about ½ inch. For example, the shale can have a mesh size of about 4, but not in excess of about 200 using a U.S. Standard sieve, preferably at least about 6 but not in excess of about 20. The shale used in the examples herein came from shale deposits in the Western States of the United States, especially the states of Colorado and Wyoming. It is often referred to as Green River oil shale, and a description of its typical composition is reported by Stanfield, K. E., Frost, I. C., McAuley, W. S. and Smith H. N. in Bureau of Mines Report of Investigations number 4825, 1951 entitled "Properties of Colorado Oil Shales," and also by Smith, John Ward in Bureau of Mines Report of Investigations number 5725, 1961 entitled "Ultimate Composition of Organic Material in Green River Oil Shale." However, this process is also applicable to oil shales from other areas, such as Chattanooga shale from Tennessee.

The oil shale is contacted with steam having a partial pressure of at least about 600 psia (4.3 MPa), preferably at least about 800 psia (5.6 MPa). The upper limit of the partial pressure of steam is no greater than about 3000 psia (20.8 MPa), preferably no greater than about 2000 psia (13.9 MPa).

The total pressure for the process of the present invention is determined mainly by the partial pressure of the steam present in the process. However, the volatility of the components of the oil shale as the process continues can add to the total pressure of the process. In general, the total pressure is at least about 800 psia (5.6 MPa), preferably at least about 1,000 psia (7.0 MPa), but no higher than 3,500 psia (24.2 MPa), preferably no higher than 2,500 psia (17.3 MPa).

A water to shale ratio can be any ratio sufficient to produce the defined partial pressure of steam. For example, the water to shale weight ratio can be at least about 1:4, preferably at least about 1:3. The upper range of the water to shale ratio is determined by the economics of operation, but need be, for example, no greater than about 3:1, preferably no greater than about 2:1.

Kerogen is rich in hydrogen and easily loses hydrogen at high temperatures. If the temperature of the process is too high, not only the quantity of the liquid product decreases because of cracking but also the product quality deteriorates because the product loses hydrogen. If the temperature of the process is too low, then the rate of reaction is too slow. The temperature of the present invention, therefore, is at least about 300° C., preferably at least about 350° C., but no greater than about 500° C., preferably no greater than 450° C.

Contact time for the process of the present invention can be at least about 0.5 hours, preferably at least about 2.5 hours, but no greater than about 6 hours, preferably no greater than about 5 hours. Best results can be obtained in 3 to 4 hours.

The process of the present invention is carried out in a fixed bed operation. By "fixed bed" I mean an operation wherein, for example, shale particles are packed in a reactor having a length to diameter ratio (L/D) ranging from about 5 to about 100, preferably about 25. Water is passed through a steam generator. The resulting steam is then passed through the fixed bed of shale particles to effect the conversion of kerogen to oil and, at the same time, to remove the oil from the spent shale. The flow rate of water in a fixed bed operation can vary from about 50 to about 1000 cc/hr, preferably about 100 to about 500 cc/hr. The corresponding space velocity can vary from about 0.1 to about 3 liquid hourly space velocity (LHSV), preferably about 0.2 to about 1.5 LHSV. Separation of the steam from the product oil can be effected by any conventional method for gas-liquid separation. For example, by introducing the reactor effluent to a high-pressure separator and then to a low-pressure separator or a flash column.

Kerogen conversion is the amount of organic carbon removed from the oil shale divided by the total amount of organic carbon contained in a shale sample multiplied by 100. The oil yield is the actual yield of liquid product in terms of Fischer Assay Oil Yield. The Fischer Assay Oil Yield is the yield of oil, in terms of gallons per ton, obtained from laboratory-scale retorting at 482° C.

In general, the process of the present invention can be carried out as follows. Oil shale can be pulverized to particles not greater than ½-inch in size, preferably ranging between 6 and 20 mesh (U. S. Standard sieve) and charged to at least one fixed bed reactor, preferably a plurality of fixed bed reactors. In the fixed bed reactor, the pulverized shale is contacted with steam at a temperature ranging from about 300° to about 500° C. under a pressure of at least about 600 psia, but no greater than about 3000 psia, for a period of time ranging from about 0.5 to about 6 hours. The reactor effluent can be collected, and the oil can be separated from the steam by means of high and/or low pressure separators at a temperature above the condensing point of the steam. The steam can be recycled to the reactor. When a plurality of reactors are employed, a reactor can be depressurized by transferring the mixture of steam and oil at the end of any particular extraction to another reactor to heat the oil shale. The sensible heat can be recovered from the spent shale before discharging it by direct contact with water to generate the make-up steam required.

DESCRIPTION OF PREFERRED EMBODIMENTS

The invention will be further described with reference to the experimental data.

EXAMPLE 1

A reactor having a 1-inch ID and a 40-inch length was first packed with 350 grams of pulverized oil shale (8 to 14 mesh size) which contained 12.8 weight percent organic carbon. The reactor was then filled with quartz chips for preheating the water which was pumped to the top of the reactor at a rate of 150 cc/hr. Subsequently, the reactor was heated over a 1-hour period to a temperature of 385° C. and a steam partial pressure of 1000 psia and remained at that temperature for 3 hours. During extraction the reactor effluent was cooled and separated into a gas stream and a liquid stream. Since the amount of gases which were produced was negligible, the gas stream was discarded. The liquid stream was collected, centrifuged, and separated into oil and water. The kerogen conversion was 80 weight percent and the oil yield was 129 percent Fischer Assay and are recorded as Run No. 6 in Table 1. Run Numbers 1 through 5 and 7 through 10 were performed identically except for variations in conditions as set forth in Table 1.

TABLE 1

Effect of Pressure and Residence Time on Kerogen Conversion and Oil Yield

| Run Number | 1 | 2 | 3 | 4 | 5 |
|---|---|---|---|---|---|
| Temperature, ° C. | 385 | 385 | 385 | 385 | 385 |
| Steam Partial Pressure, psia (MPa) | 15(0.1) | 1000(7.0) | 15(0.1) | 500(3.5) | 750(5.3) |
| Flow Rate of Water, cc/hr | 150 | 150 | 150 | 150 | 150 |
| Reaction Time, hr | 2 | 2 | 3 | 3 | 3 |
| Oil Yield, % Fischer Assay | 91 | 91 | 91 | 88 | 93 |
| Kerogen Conversion, wt % | 70 | 62 | 70 | 74 | 80 |
| **Run Number** | **6** | **7** | **8** | **9** | **10** |
| Temperature, ° C. | 385 | 385 | 385 | 385 | 385 |
| Steam Partial Pressure, psia (MPa) | 1000(7.0) | 1500(10.4) | 15(0.1) | 1000(7.0) | 1000(7.0) |
| Flow Rate of Water, cc/hr | 150 | 150 | 150 | 150 | 150 |
| Reaction Time, hr | 3 | 3 | 3 | 3 | 3 |
| Oil Yield, % Fischer Assay | 129 | 129 | 77 | 113 | 107 |
| Kerogen Conversion, wt % | 80 | 80 | 65 | 80 | 80 |

The data in Table 1 show it is critical in order to obtain both high conversions and excellent yields that the process be carried out in strict compliance with the procedures set forth herein. Thus, in each of Run Numbers 1,3,4 and 8 wherein the steam partial pressure was below 600 psia low conversions were obtained. In each of Run Numbers 5,6, 7, 9 and 10, however, with steam partial pressures within the claimed range excellent conversions and yields were obtained, particularly in Run Numbers 6, 7, 9 and 10 wherein the steam partial pressure was within the preferred operating range. It is known that as temperature increases at any selected pressure, reaction rates will increase proportionately. Accordingly, although kerogen conversion and oil yield were low in Run No. 2 it is apparent that operation of the run at higher temperatures but at the same steam partial pressure and reaction time will result in greatly increased kerogen conversion and oil yields as in Run Numbers 5, 6, 7, 9 and 10.

Obviously, many modifications and variations of the invention, as hereinabove set forth, can be made without departing from the spirit and scope thereof, and therefore only such limitations should be imposed as are indicated in the appended claims.

I claim:

1. A novel process for recovering oil from oil shale having a mesh size ranging from about 4 to about 200 U.S. Standard sieve containing kerogen which consists essentially of contacting said oil shale with steam having a partial pressure of at least about 600 psia but no greater than about 3000 psia at a reaction temperature ranging from about 300° to about 500° C. and a total pressure ranging from about 800 to about 3500 psia for a period of time ranging from about 0.5 to about 6 hours, said contact being conducted by passing steam at a liquid hourly space velocity of about 0.1 to about 3 through a fixed bed reactor containing shale, said fixed bed reactor having a length to diameter ratio of about 5 to about 100.

2. A novel process according to claim 1 wherein said shale can have a mesh size ranging from about 6 to about 20 U.S. Standard sieve.

3. A novel process according to claim 1 wherein said steam has a partial pressure of at least about 800 psia but no greater than about 2000 psia.

4. A novel process according to claim 1 wherein said process has a total pressure ranging from about 1000 psia to about 2500 psia.

5. A novel process according to claim 1 wherein said process has a water to shale weight ratio ranging from about 1:4 to about 3:1.

6. A novel process according to claim 1 wherein said process has a water to shale weight ratio ranging from about 1:3 to about 2:1.

7. A novel process according to claim 1 wherein said temperature ranges from about 350° to about 450° C.

8. A novel process according to claim 1 wherein said process has a contact time ranging from about 2.5 to about 5 hours.

9. A novel process according to claim 1 wherein said process has a contact time ranging from about 3 to about 4 hours.

10. A novel process according to claim 1 wherein said process is a fixed-bed operation having a plurality of fixed-bed reactors.

11. A novel process according to claim 1 wherein said steam has a partial pressure of at least about 800 psia but no greater than about 2000 psia and a temperature ranging from about 350° to 450° C.; and wherein said process has a total pressure ranging from about 1000 psia to about 2500 psia, a water to shale weight ratio ranging from about 1:3 to about 2:1 and a contact time ranging from about 2.5 to about 5 hours.

12. A novel process according to claim 11 wherein said contact time is about 3 to about 4 hours and wherein said process is a fixed-bed operation having a plurality of fixed-bed reactors.

13. The process of claim 1 wherein said contact is conducted by passing steam at a liquid hourly space velocity of about 0.2 to about 1.5 through a fixed bed reactor containing shale, said fixed reactor having a length to diameter ratio of about 25.

* * * * *